United States Patent [19]

Smith

[11] 3,979,844

[45] Sept. 14, 1976

[54] NEEDLEPOINTING APPARATUS AND METHOD

[76] Inventor: Ollie Nan Smith, 122 S. 7th St., Miamisburg, Ohio 45342

[22] Filed: July 24, 1975

[21] Appl. No.: 598,832

[52] U.S. Cl. ..... 38/102.91

[51] Int. Cl.[2] ..... D06C 3/08

[58] Field of Search ..... 101/127.1; 38/102, 102.1, 38/102.4, 102.9, 102.91; 160/396, 399, 402, 403, 380, 382, 383

[56] References Cited

UNITED STATES PATENTS 1,411,908 4/1922 Cacici ..... 38/102.91

1,636,681 7/1927 Carbone ..... 38/102.91

*Primary Examiner*—G.V. Larkin

[57] ABSTRACT

The edges of material to be needlepointed are releasably secured and supported by two pairs of elongated support members. An edge of the material is secured between one pair of support members and another edge of the material is wound about a third support member until the desired length of material remains between the first pair of support members and the third support member. A fourth support member is then releasably secured to the third support member.

11 Claims, 6 Drawing Figures

NEEDLEPOINTING APPARATUS AND METHOD

BACKGROUND AND SUMMARY

This invention relates to needlepointing, and more particularly, to an apparatus and method for supporting materials to be needlepointed.

Although needlepointing is becoming increasingly popular, one of the factors which has prevented needlepointing from becoming even more widespread is the difficulty in supporting the material to be needlepointed in a manner that permits the needlepointing to be performed quickly and comfortably. It is desirable that the material being needlepointed be maintained relatively flat, and if the material is simply held by the hand, the hand can become tired and cramped within a short time. Holders for the material are available, but these holders are generally not adaptable for use with material of varying size. Further, needlepointing fabric is usually relatively stiff and prior art holders are usually not capable of holding only a small portion of the fabric.

The invention permits the material to be held easily and comfortably, and any portion of a large piece of material can be held as desired. The material is held between two pairs of elongated support members, and the material can be wound about one of the support members of either or both pairs so that the desired areas of the material is between the two pairs of supports. Each pair of supports is releasably held together by elastic bands, and the ends of the supports can be temporarily separated by squeezing the metal portions together so that yarn can be inserted and retained between the ends.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
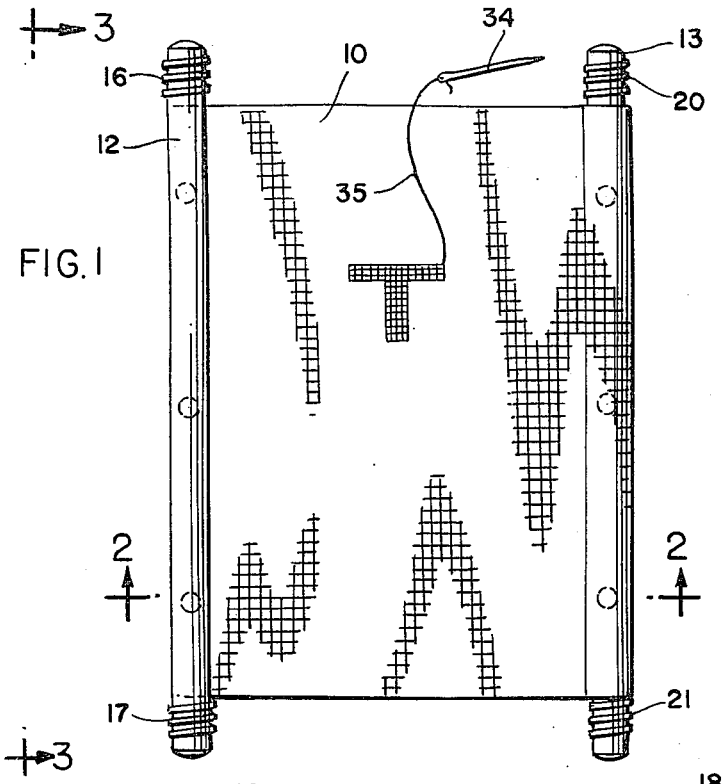
FIG. 1 is a plan view of a material to be needlepointed held between two pairs of support members.
Figure 2:
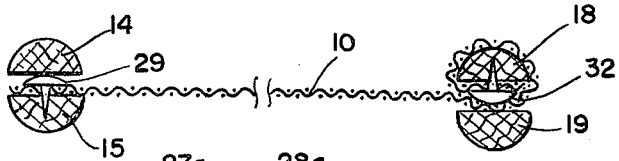
FIG. 2 is an enlarged sectional view, partially broken away, of the apparatus of FIG. 1 taken along the line 2—2 of FIG. 1.

Referring now to FIGS. 1 and 2, a generally rectangular piece 10 of needlepointing fabric extends between right and left pairs 13 and 12 of fabric support members. Although the invention will be described with reference to the art of needlepointing, it will be understood that the invention can be used for other operations such as embroidering, knitting, darning, sewing, and the like. Accordingly, the word "needlepointing" as used herein is intended to encompass all of these various operations.

The left pair of support members includes support members 14 and 15, the ends of which are held together by a pair of rubber or elastic bands 16 and 17. Each of the elastic bands may be wound about the ends of the support members as tightly as desired. Similarly, the right pair of support members includes support members 18 and 19, the ends of which are held together by elastic bands 20 and 21.

Figure 4:
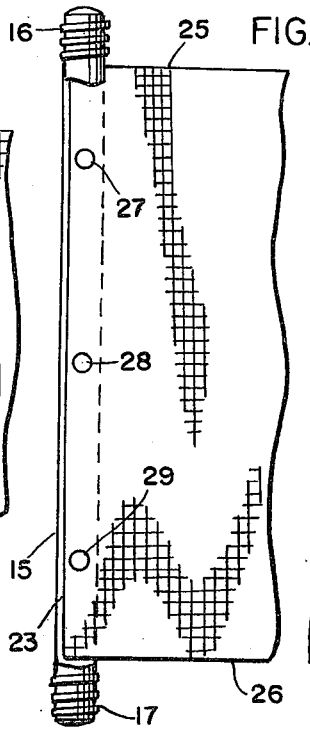
FIG. 4 is a fragmentary plan view showing the fabric in the process of being secured to the support members.

Referring now to FIG. 4, the fabric 10 is illustrated in a flattened condition and includes a pair of end edges 23 and 24 and a pair of side edges 25 and 26. The end edge 23 of the fabric is secured to the support member 15 by three tacks 27, 28 and 29, and the end edge 24 is similarly secured to the support member 19 by tacks 30, 31 and 32. In the particular embodiment illustrated, each of the support members 14, 15, 18, and 19 has a generally semi-circular cross section which provides the support member with a longitudinally extending flat surface. The flat surface facilitates the attachment of the fabric edges to the support members by the tacks, and the round outer surface facilitates winding the fabric around the support member as will be described hereinafter. The particular support members illustrated are formed from wood, and the tacks 27–32 can be conventional thumb tacks. However, the support members can be made of other materials such as plastic and steel, and other anchor means can be used to secure the fabric to the support members.

After the edge 23 of the fabric is tacked to the support member 15, the support member 14 is superposed over the fabric edge and the lower support member 15 with the flat surfaces of the support members facing each other. The ends of the support members extend beyond the side edges 25 and 26 of the fabric, and the support members are releasably secured by wrapping the elastic bands 16 and 17 about the ends.

After the right edge 24 of the fabric is tacked to the support member 18, the support member is rolled over the fabric towards the left pair of support members to wind the fabric around the support member 18 until the desired length of fabric between the left pair of support members and the support member 18 remains. This length may be selected on the basis of the area of the fabric which is to be needlepointed, the relative stiffness or flexibility of the fabric, the skill of the person doing the needlepointing, etc. After the desired length of fabric is wound about the support member 18, the support member 19 is superposed over the wound fabric and the support member 18 with the flat surfaces of the support members facing each other. The support members can then be releasably secured by winding the elastic bands 20 and 21 about the ends thereof.

Referring again to FIG. 1, after the fabric has been wound about the support member 18 and the support members 18 and 19 are secured, the relatively short length of fabric between the two pairs of support members can be comfortably held. FIG. 1 illustrates the letter "T" in the process of being needlepointed by needle 34 and yarn 35, and the support members permit the work to be discontinued and then resumed as often as desired without the need for regathering the fabric. The fabric is held firmly between the pairs of support members, and the meshes of the fabric are maintained in alignment to prevent the fabric from getting out of shape.

The area of the fabric between the two pairs of support members can be adjusted as desired by rolling or unrolling the fabric about the support member 18. As the needlepointing proceeds to the right as viewed in FIG. 1 and additional fabric material is needed, the rubber bands 20 and 21 can be removed to permit the fabric to be unrolled. If desired, the left edge of the fabric, which is secured between the left support members 14 and 15, can be rolled around the support member 15 by removing the rubber bands 16 and 17 and then resecuring the support member 14 with the rubber bands. If the first area of the fabric to be needlepointed is in the middle of the length of fabric, then both ends of the fabric can be rolled around one of the support members of the associated pair of support members before the other support member of the pair is secured by the rubber bands.

When the needlepointing is to be discontinued for a time, the fabric can be rolled into a compact configuration for carrying or storing by removing the rubber bands from one of the pairs of support members, rolling the fabric around the support member to which it is tacked until the two sets of support members are adjacent each other, and then resecuring the removed support member with the rubber bands. When the needlepointing is to be resumed, the rubber bands can be removed to permit the fabric to be unrolled the desired amount.

Figure 3:
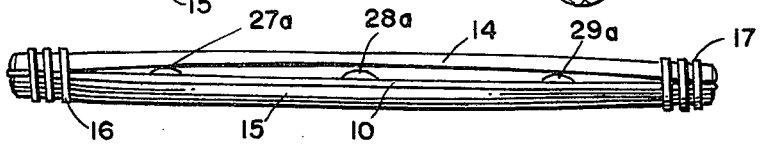
FIG. 3 is a side view taken along the line 3—3 of FIG. 1.
Figure 6:
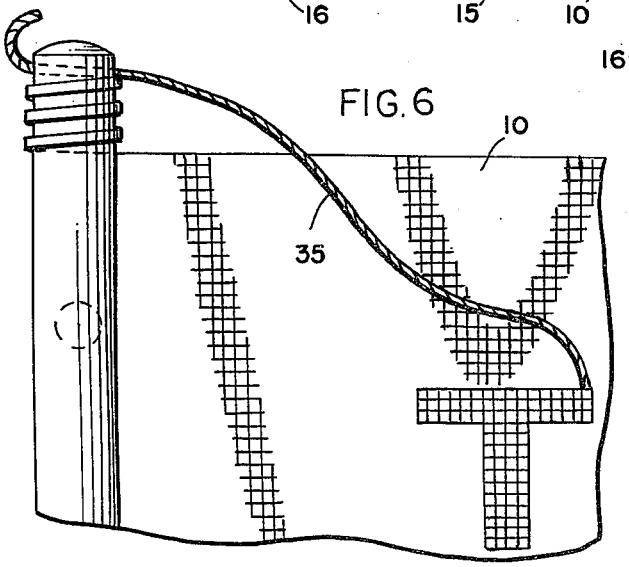
FIG. 6 is an enlarged fragmentary plan view showing the yarn being releasably anchored between the ends of the support members.
Figure 5:
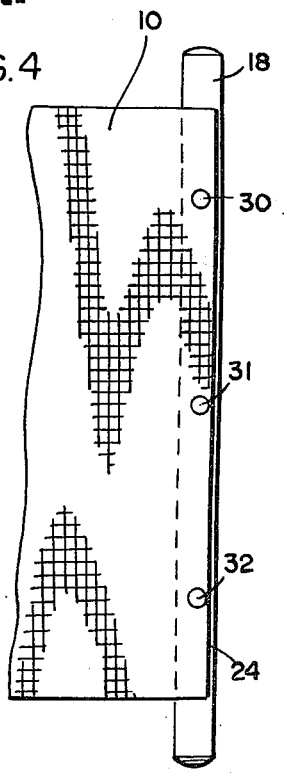
FIG. 5 is an enlarged fragmentary view of a portion of FIG. 3 showing the ends of the support members being separated.
Figure 5:
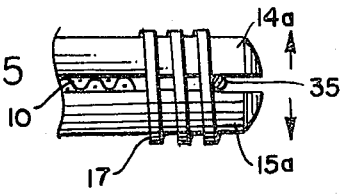

Referring to FIG. 3, the tacks 27–29 include heads 27*a*, 28*a*, and 29*a*, which separate the flat surfaces of the two support members 14 and 15. The tacks 27*a* and 29*a* are spaced from the associated ends of the support members, and the rubber bands 16 and 17 are located near the ends outwardly of the heads 27*a* and 29*a* of the tacks. The support members are desirably formed of a material which is sufficiently flexible to permit the compression force of the wound rubber bands to force the ends of the support members together about the tack heads 27*a* and 29*a*, and this causes the central portions of the support members 14 and 15 to bow away from each other so that the flat surface of the support member 14 is spaced slightly from the tack head 28*a*. When the central portions of the support members 14 and 15 are pressed together, the support members tend to straighten out and the ends of the support members separate against the compressive force exerted by the rubber bands as illustrated in FIG. 5, in which the ends 14*a* and 15*a* of the support members 14 and 15 have moved away from each other in the directions of the arrows. The resulting space between the ends of the support members permits the yarn 35 to be inserted between the ends (see also FIG. 6). When the pressure on the central portions of the support members is released, the ends 14*a* and 15*a* will be forced together again by the rubber band 17, thereby anchoring the yarn 35. Accordingly, a number of yarns of different colors can be used, and the yarns which are not being needlepointed at any particular time can be releasably anchored between the ends of the support members.

The invention not only facilitates the holding of the fabric to be needlepointed, but it greatly facilitates the needlepointing, reduces the amount of time required to complete the work and increases the accuracy of the work.

Although the particular piece of fabric shown in the accompanying drawing is rectangular, it will be understood that many different shapes of fabric can be retained between the support members and held thereby. For example, a round or oval piece of fabric can be tacked to one of the holders by locating the holder inwardly from the circumference or periphery of the fabric a sufficient distance to permit one or more tacks to be passed through the fabric into the holder.

While in the foregoing specification a detailed description of a specific embodiment of the invention was set forth for the purpose of illustration, it is to be understood that many of the details herein given may be varied considerably by those skilled in the art without departing from the spirit and scope of the invention.

I claim:

1. In combination, a needlepointing apparatus and a piece of material to be needlepointed, the material having a pair of edge portions, the needlepointing apparatus having a first pair of elongated support members, one edge portion of the material being secured between the support members of the first pair, means for releasably holding the first pair of support members together, a second pair of elongated support members spaced from the first pair, the other edge portion of the material being secured between the support members of the second pair and the portion of the material extending between the two pairs of support members being supported, and means for releasably holding the second pair of support members together.

2. The combination of claim 1 in which the ends of each support member extend longitudinally beyond the material and the means for holding the support members of each of the first and second pairs are elastic bands wound around the support members of each pair.

3. The combination of claim 1 in which the material is wound about one of the support members of one of the pairs.

4. The combination of claim 1 including a plurality of tacks securing said one edge portion to one of the support members of the first pair and a plurality of tacks securing said other edge portion to one of the support members of the second pair.

5. The combination of claim 1 including a pair of tacks securing said one edge portion to one of the support members of the second pair, the tacks being located adjacent to but spaced from the ends of said one support member and each of the tacks including a head which separates the support members, the means for holding the support members of the first pair comprising an elastic band wound around the support members between one of the tacks and the adjacent ends of the support members and an elastic band wound around the support members between the other of the tacks and the adjacent ends of the support members, the elastic bands forcing the ends of the support members of the first pair toward each other and causing the middle portions of the support members to bow away from each other, whereby the ends of the support members of the first pair can be separated when desired by squeezing the bowed middle portions of the support members together.

6. The combination of claim 1 in which each of the elongated support members has a generally semi-circular transverse cross section which provides the support member with a longitudinally extending flat surface, the support members of each pair being held together with the flat surfaces thereof facing each other.

7. The combination of claim 1 in which said material to be needlepointed is a mesh fabric.

8. A method for supporting material to be needlepointed comprising the steps of:

a. securing an edge of the material between two elongated support members, b. releasably securing the two support members together, c. securing another edge of the material to a third elongated support member, d. rolling the third support member toward the first two support members to wind the material around the third support member, and e. releasably securing a fourth elongated support member to the third support member with the wound material therebetween.

9. The method of claim 8 in which the ends of the third and fourth support members extend beyond the material and the third and fourth members are releasably secured by wrapping elastic bands around the ends of the support members.

10. The method of claim 8 in which the material is secured to the third support member by tacking the material to the support member.

11. The method of claim 8 in which the material is secured to the first two support members by tacking the material to one of the support members and is secured to the third support member by tacking the material to the third support member, the ends of each of the support members extending beyond the material, the ends of the first two elongated support members and the third and fourth support members being releasably secured by wrapping elastic bands around the ends of the support members.

* * * * *